United States Patent [19]

Moshe et al.

[11] Patent Number: 4,464,915

[45] Date of Patent: Aug. 14, 1984

[54] PADLOCK

[76] Inventors: Dolev Moshe; Bahry Avraham, both of 45 Sokolow St., Holon 58268, Israel

[21] Appl. No.: 244,063

[22] Filed: Mar. 16, 1981

[30] Foreign Application Priority Data

Mar. 25, 1980 [IL] Israel ..... 59705

[51] Int. Cl.[3] ..... E05B 15/16; E05B 67/04

[52] U.S. Cl. ..... 70/52; 70/417

[58] Field of Search ..... 70/52, 51, 53, 38 R, 70/38 A, 38 B, 38 C, 39, 25, 46, 417

[56] References Cited

U.S. PATENT DOCUMENTS 467,506 1/1892 Hunter ..... 70/52
980,798 1/1911 Krajdocha ..... 70/51
1,195,745 8/1916 Snyder ..... 70/52
1,289,279 12/1918 Schreiter ..... 70/52
2,872,803 2/1959 Swanson ..... 70/53

*Primary Examiner*—Robert L. Wolfe
*Attorney, Agent, or Firm*—McAulay, Fields, Fisher, Goldstein & Nissen

[57] ABSTRACT

In order to lessen the cost of manufacturing padlocks, the body of the padlock is made of a shell of hardened steel and has two holes in one wall for the reception of the legs of the shackle, a core with corresponding bores for said legs and for a locking mechanism made of a soft alloy, the bores for said legs within the core being partially lined with hardened steel inserts facing the open ends of said shell, said inserts holding said core within said shell. The core may be cast, extruded or may be made by sintering.

6 Claims, 4 Drawing Figures

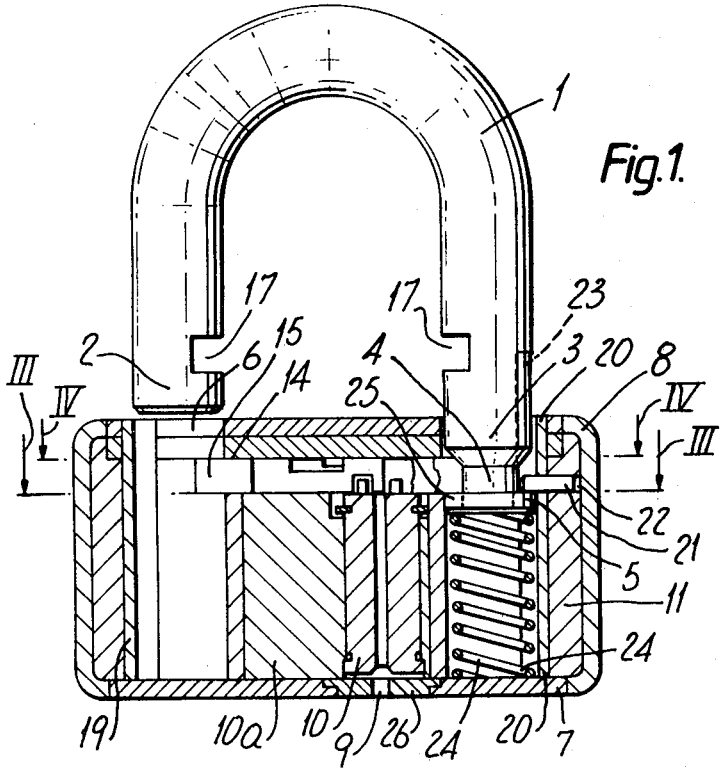
Fig.1.
Fig.2.
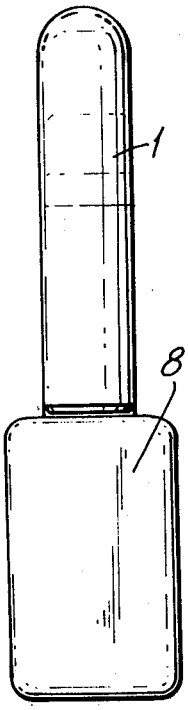
Fig. 3.
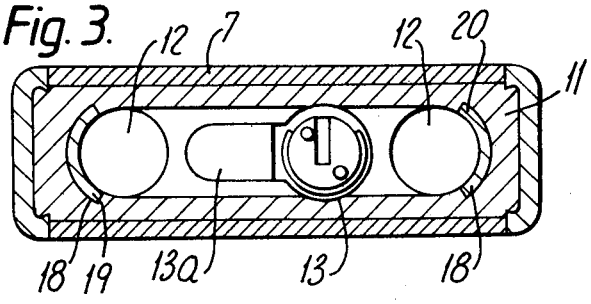
Fig.4.
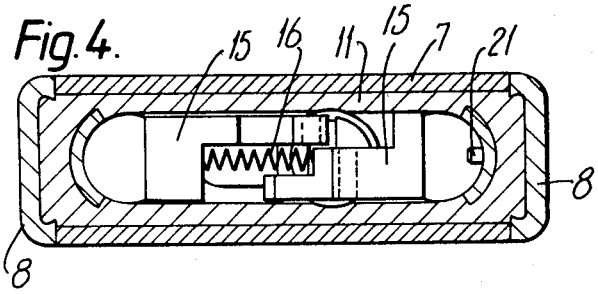

PADLOCK

The present invention concerns a padlock.

Padlocks generally comprise a shackle, the legs of which are inserted in the bores of a block-like housing and are held therein by latches or the like actuated by any suitable lock, i.e. cylinder lock, bolt lock or the like.

The manufacture of these padlocks is generally very expensive, since the bores for the legs of the shackle, the space for the latches and their locking means, must be carefully machined in order that the lock may function properly. In this connection it is important that the block-like housing is made of hardened metal, preferably steel, in order to make it extremely difficult for an unauthorized person to tamper with it, e.g. by drilling or sawing. Needless to say that this construction makes for an unduly expensive padlock.

It is the object of the present invention to provide a padlock which meets all the requirements of strength and of tamper-proof construction, but is comparatively cheap in manufacture.

The invention consists in a padlock comprising a shell of hardened steel open at opposite ends and having in one wall two holes for the reception of the legs of the shackle, a core with corresponding bores for said legs and for a locking mechanism made of a soft alloy, the bores for said legs within the core being partially lined with hardened steel inserts facing the open ends of said shell, said inserts holding said core within said shell.

The core with its borses is either cast, made by extrusion, or is made of sintered metal. Thus, almost no machining is required for any of the parts of said core.

The invention is illustrated, by way of example only, in the accompanying drawings in which:

FIG. 1 is a vertical section of a padlock according to the invention;

FIG. 2 is an end view thereof;

FIG. 3 is a section thereof taken on line III—III of FIG. 1;

FIG. 4 is a section thereof taken on line IV—IV of FIG. 1.

The padlock according to the invention comprises a shackle 1 having legs 2 and 3, the legs 3 being longer and being provided near its end with a reduced section 4 ending with a disc 5 of the same diameter as the main part of the leg for a purpose which will be explained hereinafter.

The shackle 1 extends through apertures 6 in the top of a shell 7 of hardened metal, e.g. steel. The shell is open at opposite ends, said ends being covered by decorative end plates 8. In the bottom of shell 7 a hole is provided for a seat of a hardened steel disc 26 in which a slot 9 is made to permit the insertion of the key (not shown) for a cylinder lock or any other suitable lock. In the embodiment here illustrated a cylinder lock 10, **10*a*** is used.

A core 11 is provided within shell 7, said core being cast, extruded, sintered or molded. The core comprises throughgoing bores 12 aligned with bores 6 and a bore 13 aligned with hole 9, a cavity **13*a* for lock part 10*a* being likewise provided. Furthermore, at the top of the core a space 14 is provided for the disposition of the latches 15 which are urged by spring 16 into a position to engage cut-outs 17 made in the legs 2 and 3 of the shackle, as known. The core also comprises arcuate grooves 18 adjacent bores 12, which grooves face the ends 8. In these grooves arcuate inserts 19, 20 of hardened metal, e.g. steel, are provided. These inserts 19, 20 which are flush with the top of shell 7 guard the lock against tampering by drilling from the direction of the open ends of shell 7. Furthermore, the inserts 19, 20 serve to anchor core 11 within shell 7. Insert 20 is provided with an aperture through which a pin 21 extends, said pin being housed in a horizontal bore 22 of core 11. A vertical groove 23 is provided in the end of leg 3 so that pin 21 can extend therein when the shackle is in the locked position against the action of a spring 24 housed within bore 12. The shackle can be removed completely from its housing. For this purpose a slot 25 is provided in disc 5 so that when the shackle is rotated around leg 3, slot 25 permits the movement of said shackle past pin 21. Below the top wall of shell 7 a safety plate 26** of hardened steel having suitable bores and cut-outs is provided.

It can be seen that the manufacture of the padlock above described is simple. In order to assemble it, first disc 26 is inserted into the shell. Thereafter lock 10, **10*a*, latches 15 and spring 16, and safety plate 26 are placed into proper position within the core, the core is inserted from one open end of shell 7 into said shell, inserts 19 and 20 and spring 24 are inserted from above into the respective bores, whereafter pin 21 is inserted into core 11 to extend through insert 20. In this manner the core is fastened within shell 7. The end plates 8 are thereafter mounted on the core and shell whereby the housing is ready to receive the shackle. If desired, the decorative end plates 8** may be dispensed with.

It can be seen that the locking mechanism can be easily exchanged for another for any desired or required reason.

We claim:

1. A padlock comprising a shell of hardened steel open at opposite ends and having in one wall the holes for the reception of the legs of the shackle, a core with corresponding bores for said legs and for a locking mechanism made of a soft alloy, the bores for said legs within the core being partially lined with hardened steel inserts facing the open ends of said shell, said inserts holding said core within said shell.

2. A padlock as claimed in claim 1, wherein a pin is provided extending laterally from one end of said core through an aperture in said insert into a groove provided in one leg of said shackle.

3. A padlock comprising a shell of hardened steel open at opposite ends, which are covered by decorative plates, and having in one wall two holes for the reception of the legs of the shackle, a core with corresponding bores for said legs and for a locking mechanism made of a soft alloy, the bores for said legs within the core being partially lined with hardened steel inserts facing the open ends of said shell, said inserts holding said core within said shell.

4. A padlock comprising a shell of hardened steel open at opposite ends and having in one wall two holes for the reception of the legs of the shackle, a core made by casting and having corresponding bores for said legs and for a locking mechanism made of a soft alloy, the bores for said legs within the core being partially lined with hardened steel inserts facing the open ends of said shell, said inserts holding said core within said shell.

5. A padlock comprising a shell of hardened steel open at opposite ends and having in one wall two holes for the reception of the legs of the shackle, a core made by extrusion and having corresponding bores for said legs and for a locking mechanism made of a soft alloy, the bores for said legs within the core being partially lined with hardened steel inserts facing the open ends of said shell, said inserts holding said core within said shell.

6. A padlock comprising a shell of hardened steel open at opposite ends and having in one wall two holes for the reception of the legs of the shackle, a core made by sintering and having corresponding bores for said legs and for a locking mechanism made of a soft alloy, the bores for said legs within the core being partially lined with hardened steel inserts facing the open ends of said shell, said inserts holding said core within said shell.

* * * * *